US006460279B1

(12) United States Patent
Stanley et al.

(10) Patent No.: US 6,460,279 B1
(45) **Date of Patent: *Oct. 8, 2002**

(54) CUSTOM DISPLAY AND STORAGE SYSTEM

(76) Inventors: Kay L. Stanley, 6785 W. 152$^{nd}$ Ter., Overland Park, KS (US) 66223; Curt D. Seymour, 6785 W. 152$^{nd}$ Ter., Overland Park, KS (US) 66223

( * ) Notice: Subject to any disclaimer, the term of this patent is extended or adjusted under 35 U.S.C. 154(b) by 25 days.

This patent is subject to a terminal disclaimer.

(21) Appl. No.: 09/610,115

(22) Filed: Jun. 30, 2000

(51) Int. Cl.$^{7}$ ..... G09F 7/16

(52) U.S. Cl. ..... 40/595; 40/594; 40/618; 40/773; 40/775

(58) Field of Search ..... 40/594, 595, 771, 40/772, 776, 618, 775, 770, 773, FOR 1

(56) References Cited

U.S. PATENT DOCUMENTS

| | | | | | |
|---|---|---|---|---|---|
| 156,788 | A | | 11/1874 | Hale | |
| 187,704 | A | | 2/1877 | Clare | |
| 949,328 | A | | 2/1910 | Milner | |
| 1,330,894 | A | * | 2/1920 | Muffley | 40/260 |
| 1,376,677 | A | * | 5/1921 | Coufal | 40/158 |
| 1,770,803 | A | | 7/1930 | Porstner et al. | |
| 1,862,897 | A | | 6/1932 | Klie | |
| 1,870,221 | A | * | 8/1932 | Babcock | 40/158 |
| 1,877,919 | A | | 9/1932 | Livingston | |
| 2,093,264 | A | | 9/1937 | Chernow | |
| 2,195,042 | A | | 3/1940 | Wishinsky | |
| 2,524,306 | A | * | 10/1950 | Buzzerd | 40/158 |
| 2,586,039 | A | | 2/1952 | Heggedal | |
| 2,828,567 | A | | 4/1958 | Shoan | |
| 2,844,901 | A | | 7/1958 | Eisen | |
| 2,850,294 | A | * | 9/1958 | Ortis et al. | 40/250 |
| 2,871,601 | A | | 2/1959 | Warnow | |
| 3,063,338 | A | | 11/1962 | Bregman | |
| 3,079,715 | A | | 3/1963 | Cross | |
| 3,172,687 | A | * | 3/1965 | Lawrence | 40/158 |
| 3,295,674 | A | | 1/1967 | Shore | |
| 3,338,395 | A | | 8/1967 | Silverstein | |
| 3,402,495 | A | | 9/1968 | Fishback | |
| 3,440,746 | A | | 4/1969 | Richards | |
| 3,440,750 | A | | 4/1969 | Toth et al. | |
| 3,526,986 | A | * | 9/1970 | Dempnock | 40/574 |
| 3,626,616 | A | * | 12/1971 | Seme | 40/574 |
| 3,959,906 | A | * | 6/1976 | Norris, Jr. et al. | 40/125 |
| 4,110,923 | A | * | 9/1978 | Shore | 40/152 |
| 4,164,085 | A | * | 8/1979 | Steeb et al. | 40/152 |
| 4,172,332 | A | * | 10/1979 | Holes et al. | 40/159 |
| 4,340,976 | A | | 7/1982 | Wright | |
| 4,356,649 | A | * | 11/1982 | Diamond et al. | 40/159 |
| 4,393,612 | A | | 7/1983 | Clark | |
| 4,736,536 | A | | 4/1988 | Doman | |

(List continued on next page.)

OTHER PUBLICATIONS

Sales Literature of K & Company 1996 Overland Park, Kansas.

*Primary Examiner*—Christopher P. Schwartz
*Assistant Examiner*—Benjamin A Pezzlo
(74) *Attorney, Agent, or Firm*—Spencer Fane Britt & Browne LLP

(57) ABSTRACT

A custom display storage system includes storage and display assemblies. The storage assembly includes an album or scrapbook containing pages for mounting graphic works and other generally planar objects. The display assembly includes a display unit joined at the edges with a backing to form a pocket. The display unit includes openings for display of custom character strings as well as graphic images. The backing includes a slot providing access to the pocket. A base sheet having a guide grid for mounting images, including a string of preprinted character units may be slid through the slot and into the pocket in alignment for display via the front display unit openings. Alternatively, the system may include a container for storing three dimensional items as well as graphic works. The custom display storage system may also comprise a kit with a selection of character units and an album or storage container with a variety of display units.

19 Claims, 2 Drawing Sheets

U.S. PATENT DOCUMENTS 4,738,043 A 4/1988 Ernst
4,809,451 A * 3/1989 Suzuki ..... 40/158.1
4,991,336 A * 2/1991 Lucke ..... 40/630
5,025,579 A 6/1991 Krueger
D350,365 S * 9/1994 Kelley et al. ..... D19/27
5,361,521 A 11/1994 Burtch
5,419,589 A 5/1995 Fattore
5,466,008 A * 11/1995 Ozeki ..... 281/31
5,483,762 A 1/1996 Hogan
5,662,447 A * 9/1997 Tsai ..... 412/1
5,787,626 A * 8/1998 Bingham et al. ..... 40/735
5,882,038 A * 3/1999 Ong ..... 281/31
5,918,398 A 7/1999 Stanley et al.
6,045,161 A * 4/2000 Ashcraft et al. ..... 281/37
6,288,719 B1 * 9/2001 Squilla et al. ..... 345/350
D449,853 S * 10/2001 Myers ..... D19/26
6,305,714 B1 * 10/2001 Rossetto et al. ..... 281/37

* cited by examiner

BABY
B
10
12
14
16
18
20
22
24
26
28
30
32
36
38
40
42
44
46
50
52
54
56
58
60
62
64
66
68
70
72
74
76
78
80
82
84
86
88
90
92
94
2.
5.

CUSTOM DISPLAY AND STORAGE SYSTEM

BACKGROUND OF THE INVENTION

1. Field of the Invention

The present invention relates generally to systems for storage and display. More particularly, it is concerned with a system providing storage for prints and the like and a display for graphic images and custom character strings formed from a selection of character units.

2. Description of the Related Art

Display devices and systems are well known. One example is referenced in U.S. Pat. No. 5,918,398 issued to the applicants on Jul. 6, 1999, which patent is incorporated herein by reference. Such prior art display system comprises a mat having front and back surfaces and a character string opening, a base sheet with a guide grid for mounting a string of preprinted character units, and tape strips for attaching the base sheet to the back surface of the mat. Such display systems are suitable for mounting and displaying graphic images such as pictures, prints and photographs, collectibles such as autographs, stamps, postcards, menus, coins, records and discs, and keepsakes such as newspaper clippings, announcements, programs and pressed flowers in a custom arrangement which may include text as well as images.

Such custom display systems are generally employed with a framing assembly, which may also include additional mats and a protective covering such as glass or plastic. Decorative devices such as ribbons, bows and findings may be fastened to the outside of the framing assembly. The framed systems may be wall or easel mounted, or they may be free standing, and two or more display systems may be coupled together.

While these systems are particularly well-suited for customized display of a limited number of graphic items and custom character strings, they do not provide easily accessible storage for quantities of additional similar items or of three dimensional items. In order to modify the custom display, it is necessary to disassemble the unit and unfasten the tape strips from the rear surface of the mat. Repeated removal of the base sheet and replacement of the tape is inconvenient and over time it may cause damage to the rear surface of the mat.

SUMMARY OF THE INVENTION

The present invention provides a greatly improved custom display storage system which includes a custom display as well as a convenient storage unit for a quantity of additional items. The display may be easily personalized with graphic images and characters according to individual taste, and is specially designed to permit easy modification without damage to the system.

Broadly speaking, the system includes a storage assembly and a display assembly. The storage assembly includes an album or scrapbook containing pages for mounting graphic works and other generally planar objects. The display assembly includes a display unit joined at the edges with a backing to form a pocket therebetween. The display unit includes openings for display of custom character strings as well as graphic images. The backing includes a slot providing access to the pocket.

A base sheet having a guide grid for mounting images, including a string of preprinted character units, may be slid through the slot and into the pocket. The base sheet is sized to fit snugly within the pocket so that the character string and graphics are aligned for display via the display unit openings without the need for adhesive strips or other fasteners.

Alternatively, the system may include a container for storing three dimensional items as well as graphic works. In such embodiments, the top and/or sidewall of the container is constructed with a display assembly to include one or more pockets for receiving a base sheet with images and character units. The custom display and storage system may also comprise a kit including a character assortment corresponding to the alphabet and numerals and an album or storage container with a variety of display unit configurations.

OBJECTS AND ADVANTAGES OF THE INVENTION

The principal objects and advantages of the present invention include: providing a custom display storage system; providing such a system which permits display of graphic images as well as text while also providing storage for a quantity of additional graphic images; providing such a system which permits display via display unit openings without the need for fasteners; providing such a system which includes storage for a quantity of three dimensional items; providing such a system which permits easy modification of the display without damage to the system, providing such a system which utilizes individual character units for forming character strings; providing such a system which provides different character unit options; providing such a system which accommodates different lengths of character strings in a character string display unit opening; providing such a system with a display unit including image windows; providing such a system which includes a pocket for receiving a base sheet with prepositioned images and characters; providing such a system which is easy to use without special training, tools or equipment, providing such a system which can produce a wide variety of custom storage displays; providing such a system which accommodates personalized display subject matter, providing such a system which can incorporate one or more personalized images in the display; providing such a system which can be offered as a kit; providing such a system which is well adapted for point-of-purchase sales in retail establishments; providing such a system which can offer a wide range of different character lettering styles, colors and other visual and aesthetic effects; and providing such a system which is economical to manufacture, efficient in operation, capable of a extended usage and particularly well adapted for the purposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Custom Display and Storage System

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2, 3, 4:
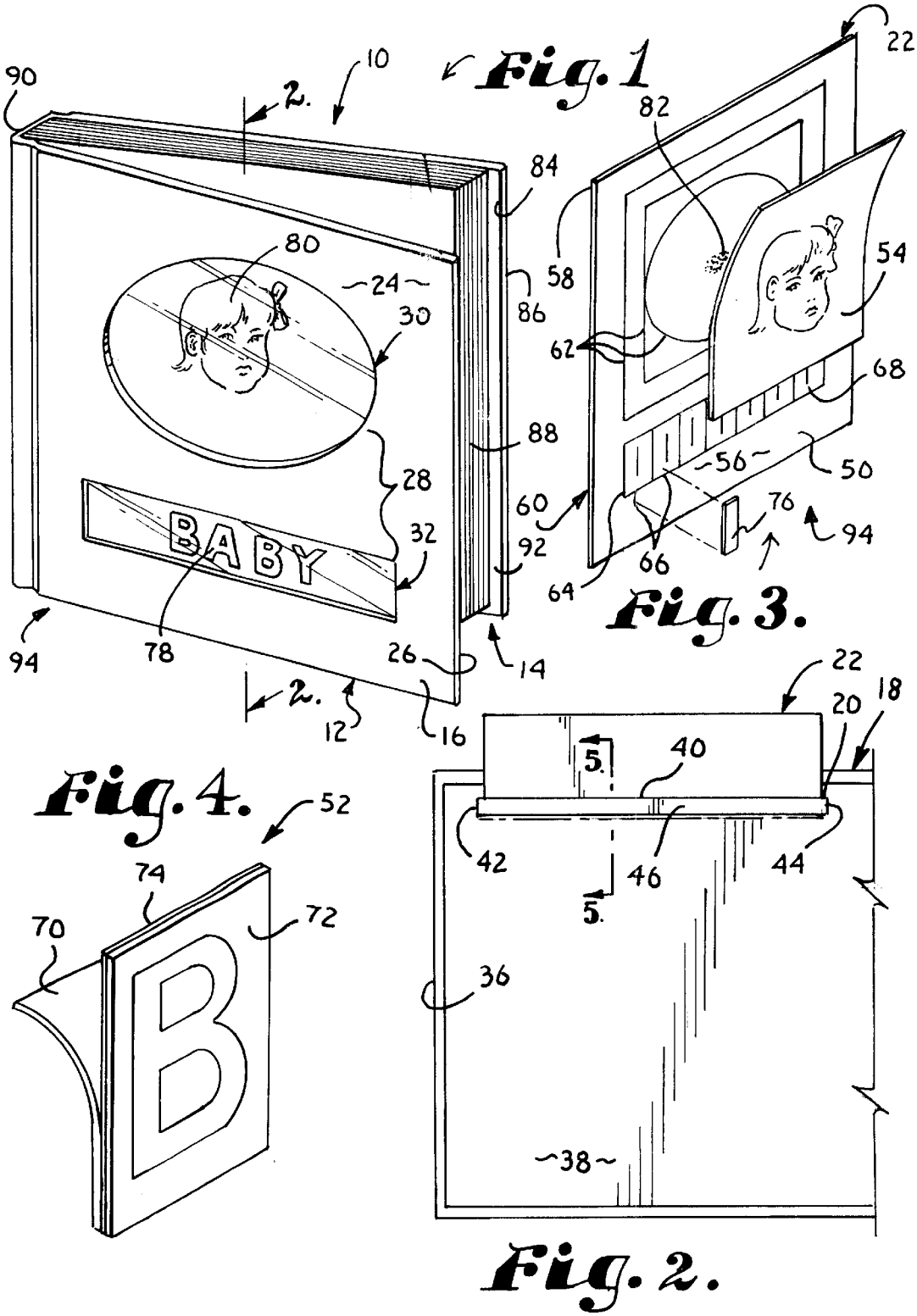
FIG. 1 is a front perspective view of a custom display and storage album/scrapbook in accordance with the invention.
FIG. 2 is a rear plan view of the display assembly depicted in FIG. 1, showing insertion of a display sheet through a slot in the backing and into a pocket in the display unit.
FIG. 3 is an exploded perspective view of a display sheet showing placement of a graphic image and fractional character unit.
FIG. 4 is a perspective view of a character subassembly showing a character lining partially peeled away from adhesive on the back of the character unit.

Referring now to the drawings, a custom display and storage system 10 in accordance with the invention is illustrated in FIGS. 1–3 and includes a display assembly 12 and a storage assembly 14. The display assembly 12 includes a display unit 16 coupled at the edges with a backing 18 to form a pocket 20 therebetween for receiving a display sheet 22.

The display unit 16 includes a front surface 24 and a back surface 26 and a window array 28, including an image window 30 and a character window 32. A clear synthetic resin glazing 34 is coupled with the display unit back surface 26 by adhesive or other means. Although FIG. 1 depicts a display unit 16 having a generally planar rectangular configuration, with rectangular and oval windows 28, the configuration of both display unit and windows may be of any suitable geometric shape, and any number of image and character windows 30 and 32 may be provided. It is foreseen that a separate window may be provided for each character in a character string.

The display unit 16 may also be constructed in layers in order to permit insertion of additional material such as polyester fiberfill between the front and back surfaces 24 and 26 in order to give a padded appearance. The display unit front surface 24 may be constructed of paper, cloth, synthetic resin, wood or any suitable material and it may be figured with a design. Ribbons, bows or findings may be applied to the front surface 24.

The backing 18 also includes a front surface 36 and a back surface 38. The front surface 36 is coupled with the display unit back surface 26 at the edges to form the pocket 20. It is also foreseen that the surfaces may be coupled at one or more intermediate locations to form two or more pockets 20.

The backing 18 is equipped with a slot 40 having a pair of generally transverse end cuts 42 and 44, which form a flap 46. FIG. 2 depicts the slot 40 in a generally horizontal orientation. A corresponding slot 40 is provided for access to each pocket 20, and it is foreseen that more than one slot 40 may be provided for access to a single pocket 20. Thus, any number of slots may be provided and they may be oriented in any suitable arrangement, such as vertically or diagonally. It is also foreseen that the flap may be omitted and a wider opening may be substituted.

The display sheet 22 is sized to be received and frictionally held in place within the pocket 20 and it includes a base sheet 50, a plurality of character subassemblies 52 and graphic images 54. The base sheet 50 is of thin, planar construction, including front and back surfaces 56 and 58 surrounded by a perimeter edge 60. The front surface 56 is imprinted with an image locator grid 62 and a character guide grid 64.

The character guide grid 64 is configured to correspond to the dimensions and locations of the corresponding character window opening 32. The character grid 64 has a generally rectangular overall configuration with printed lines indicating individual character locations 66 as well as fractional space dividers 68. The image locator grid 62 is imprinted in accordance with the dimensions of the corresponding image window and with appropriate standard sizes of photographic prints. In this manner, for example, a 4"×6" rectangular photographic print may be aligned with a 4"×6" oval image window 30, without the need for cropping of the print.

Each of the character subassemblies 52 includes a character lining 70 mounting a character unit 72 by means of a layer of a releasable adhesive composition 74. The character units 72 are adapted for peeling away from the lining 70 and fastening in the appropriate character locations 66 by means of the adhesive 74. Alternatively, the character units 72 and adhesive 74 may be supplied separately, and combined at the time of use. In such embodiments, the adhesive may be in the form of a liquid composition of double-sided tape. The character units 72 are imprinted with letters, numbers or decorative graphic designs, and fractional character units 76 are provided as well. A series of character units 72 is selected and used to form a character string 78, which may spell an appropriate word indicating a theme, e.g., "STANLEY 2000".

A graphic image 80, is sized to generally correspond to the image locator grid 62. The image 80 is mounted on the base sheet 50 by suitable adhesive mounting means 82, such as a liquid adhesive composition or double-sided tape strip.

An album-type storage assembly 14 is depicted in FIG. 1 and includes a front cover formed by the display assembly 12, a back cover 84 including a facing 86 and a plurality of pages 88. The pages 88 are fastened together at one end and covered by a spine 90, which extends between the display assembly 12 and back cover 84. The display assembly backing 18 and back cover facing 86 are each configured of sufficient width to extend beyond the respective display unit 16 and back cover 84 in order to provide a flyleaf 92 which is folded over and adhered to a first and last album page 88 respectively. The pages 88 may be decorated by imprinting or embossing.

FIG. 1 depicts an album having such a book-type binding, however any of a number of alternate bindings may be employed. Those albums permitting removal and replacement of the pages 88, such as, for example, post, ring and strap-type bindings are particularly preferred. The pages 88 may include pockets for receiving photographs or other memorabilia, or adhesive sheets with plastic cover slips which may be removed by peeling and reattached over an item to be stored. The pages may also be equipped with adhesive corners, for mounting graphic items.

The custom display and storage system 10 may be provided as a kit 94 for display and marketing purposes, for example at a retail location in a point-of-purchase display. The kit 94 includes an assortment of individual character units 72 and thematically decorated storage albums 14 having different sizes and configurations of openings 28.

In use, a wide variety of character units 72 as well as fractional units 76 are provided to permit selection and assembly of a personalized character string 78 including names, dates, or other numerical identifiers reflecting a preselected theme, such as a wedding, baby, school, graduation, vacation, anniversary or type of material to be stored, such as railroad memorabilia. The system 10 may be selected based on the window array 28 and overall theme of decoration. The character string 78 is determined, and corresponding character units 72 and one or more graphic images 54 are selected.

A user next peels the character units 72 from the liner 70 and adhesively secures them in the character locations 66 within the character guide grid 64 on the display sheet 22. The character string 78 will generally be centered within the character window 32 and fractional character units 76 may be employed to fill in any remaining space on either side. Depending on the dimensions of the graphic image 54, it may be cropped in order to achieve general correspondence with the dimensions of the image window 30, and then fastened within an appropriate image locator grid 62 with an adhesive 82.

The user next aligns the completed display sheet 22 so that the front surface 56 bearing the image 54 and character string 78 faces the backing rear surface 36. The user then opens the flap 46, aligns the leading edge of the perimeter 60 of the sheet 22 between the end cuts 42 and 44 and slides the sheet 22 through the slot 40 and into the pocket 20. In this manner, the sheet 22 is mounted and frictionally held in place between the display unit back surface 26 and the backing front surface 36 with the image 54 and character string 78 aligned for viewing through the windows 30 and 32.

The album storage pages 88 may then be filled, either at once, or over time as items are collected, with additional graphic images and other similar items. At any time the process may be reversed and the display sheet 22 removed and redecorated by removing and replacing the image 54 and/or one or more character units 72.

II. Modified Custom Display and Storage System

Figure 6:
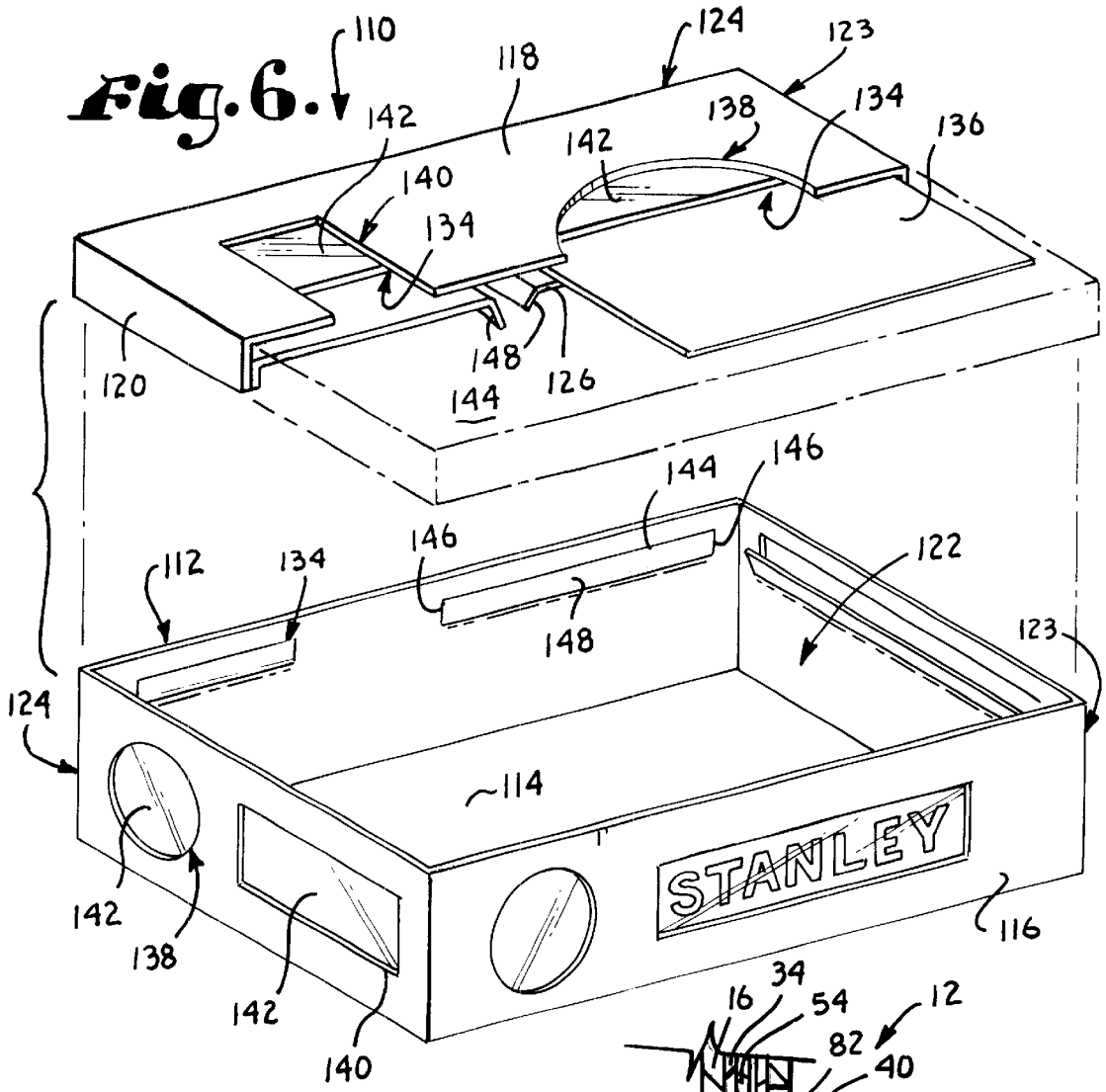
FIG. 6 is a perspective view of a first modified custom display system having a storage container, with parts broken away to show the structure of display units in the top and installation of a display sheet in the pocket of a display unit.
Figure 5:
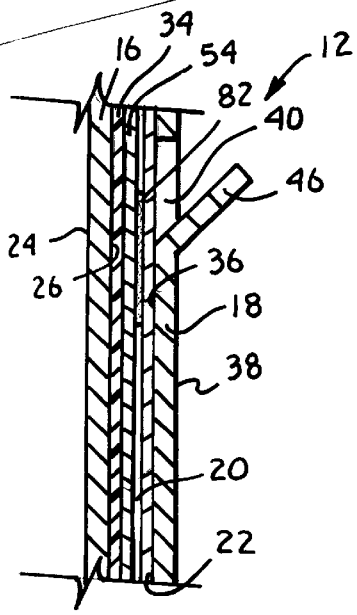
FIG. 5 is a cross sectional view taken along line 5—5 of FIG. 2.

FIG. 6 depicts a custom display and storage system 110 with a storage assembly 112 in the form of a container having a bottom 114, upstanding sidewalls 116, a top 118 and a depending rim 120 defining a storage area 122. The sidewalls 116 are constructed to include a display assembly 123, having a display unit 124 coupled around the edges with a backing 126 to form a pocket 134 therebetween for receiving a display sheet 136 as in the album-type storage assembly previously described.

The display assembly 123 includes an image window 138 and a character window 140, with glazing 142. The backing 126 includes a slot 144 having a pair of vertical end cuts 146 which form a flap 148. The top 118 may also be constructed in this manner, with the slot 144 located at the center, away from the dependent rim 120. In that case, two pairs of vertical end cuts 146 and a pair of opposed flaps 148 are provided to permit access to both ends of the pocket from the center slot 144. It is foreseen that in certain embodiments the top 118 may be of rimless construction to facilitate coupling with one of the sidewalls 116 by a hinge or other means. In such instances the slot 144 may be located adjacent an edge.

In use, the modified custom display and storage system is assembled as previously described. Where the image and character windows 138 and 140, respectively, are located on a container top 118 having a depending rim 120 and a centrally located opening 144, a pair of display sheets 136 may be installed by sliding each sheet 136 into the pocket 134 from the center toward the end of the top 118. Where the sidewalls 116 are provided with a plurality of slots 144, a corresponding number of display sheets 136 may also be employed.

Those skilled in the art will appreciate that a wide variety of custom display and storage systems can be devised which are within the scope of the present invention. For example, various numbers and configurations of image and character string windows could be formed in the display unit and could assume other geometric shapes, including polygons, diamonds and circles.

It is to be understood that while certain forms of the present invention have been illustrated and described herein, it is not to be limited to the specific forms or arrangement of parts described and shown.

What is claimed as new and desired to be secured by letters patent is:

What is claimed and desired to be secured by Letters Patent is as follows:

1. A custom display and storage system, comprising:

a) a display unit having a character string opening;

b) a character string including a plurality of character units, each having a character thereon;

c) a display sheet having a guide grid thereon, including a plurality of character locations;

d) an adhesive positioned to mount said character units to said display sheet to form a selected character string;

e) a backing coupled with said display unit and having an elongate slot;

f) a pocket formed between said display unit and said backing and receiving said display sheet with said character string positioned in an aligned relationship with said character string opening; and g) a storage unit coupled with said display unit.

2. A custom display and storage system in accordance with claim 1, wherein:

a) said display unit includes an image display window for displaying a graphic image; and b) an image is mounted on said display sheet and visible in said image window.

3. A custom display and storage system in accordance with claim 1, wherein:

a) said display unit includes a plurality of image windows.

4. A custom display and storage system in accordance with claim 1, wherein:

a) said display unit includes a plurality of character string openings.

5. A custom display and storage system in accordance with claim 1, wherein:

a) said character string includes a plurality of fractional character units; and b) said guide grid includes a plurality of fractional character locations to facilitate positioning said fractional character units on said display sheet.

6. A custom display and storage system in accordance with claim 1, wherein:

a) said display unit slot includes a movable flap to thereby enlarge said slot to facilitate receiving said display sheet.

7. A custom display and storage system in accordance with claim 1, wherein:

a) a plurality of display sheets are provided for mounting said character units; and b) a plurality of pockets are formed between said display unit and said backing for receiving said display sheets.

8. A custom display and storage system in accordance with claim 1, wherein:

a) said storage unit includes an album for storing a plurality of generally planar items.

9. A custom display and storage system in accordance with claim 1, wherein:

a) said storage unit includes a container for storing a plurality of three dimensional items; and b) said container includes a bottom and a sidewall.

10. A custom display and storage system in accordance with claim 9, wherein:

a) said container includes a lid; and b) said lid includes said display unit.

11. A custom display and storage system in accordance with claim 10, wherein:

a) said storage unit lid is removably coupled with said storage unit.

12. A custom display and storage system in accordance with claim 1, wherein:

a) said display unit opening includes a first movable flap and a second movable flap to thereby enlarge said opening to facilitate receiving a pair of display sheets.

13. A custom display and storage system in accordance with claim 9, wherein:

a) said container sidewall includes said display unit.

14. A custom display and storage system in accordance with claim 9, wherein:

a) said display unit includes a plurality of openings.

15. A custom display and storage system in accordance with claim 9, wherein:

a) said container comprises a box having a plurality of sidewalls; and b) a plurality of said sidewalls include a display unit.

16. A custom display and storage system, comprising:

a) a display unit having a character string opening;

b) a character string having a plurality of character units, each having a height and a width and a character formed thereon;

c) a display sheet having a guide grid thereon and receiving said character string, said guide grid locating said character units on said display sheet and including upper and lower horizontal lines extending in substantially parallel spaced apart relation and a plurality of substantially parallel vertical lines extending in spaced apart relation between and perpendicular to said horizontal lines;

d) an adhesive positioned to adhere said character units to said display sheet to form a selected character string;

e) a backing coupled with said display unit and having an elongate opening;

f) a pocket formed between said display unit and said backing and receiving said display sheet with said character string positioned in alignment with said character string opening; and g) a storage unit coupled with said display unit.

17. A custom display and storage system in accordance with claim 16, wherein:

a) said display unit includes an image display window for displaying a graphic image; and b) an image mounted on said display sheet and visible in said image window.

18. A custom display and storage system in accordance with claim 16, wherein:

a) said display unit includes a plurality of image windows and character openings.

19. A custom display and storage system kit, comprising:

a) a plurality of display units, each having a plurality of different sized image display windows and character string display openings;

b) a plurality of character strings, each including a plurality of character units, each character unit having a character thereon;

c) a plurality of display sheets, each having a guide grid thereon, including a plurality of character locations;

d) an adhesive positioned to adhere said character units to said display sheets to form a plurality of selected character strings;

e) each display unit coupled with a backing including an elongate slot;

f) a pocket formed between each said display unit and said backing for receiving a selected one of said display sheets with a selected character string positioned thereon in aligned relationship with said character string opening; and g) a storage unit coupled with each said display unit.

* * * * *